US012108866B1

(12) United States Patent
Moraca

(10) Patent No.: US 12,108,866 B1
(45) Date of Patent: Oct. 8, 2024

(54) CONVERTIBLE ONE-PIECE, ALL-IN-ONE, FANNY PACK TO BACKPACK DEVICE AND METHOD OF USE

(71) Applicant: Anthony Moraca, Pittsburgh, PA (US)

(72) Inventor: Anthony Moraca, Pittsburgh, PA (US)

( * ) Notice: Subject to any disclaimer, the term of this patent is extended or adjusted under 35 U.S.C. 154(b) by 0 days.

(21) Appl. No.: 18/614,249

(22) Filed: Mar. 22, 2024

Related U.S. Application Data

(60) Provisional application No. 63/491,977, filed on Mar. 24, 2023.

(51) Int. Cl.
*A45F 4/02* (2006.01)
*A45F 3/00* (2006.01)
*A45F 3/04* (2006.01)

(52) U.S. Cl.
CPC ..... *A45F 4/02* (2013.01); *A45F 3/005* (2013.01); *A45F 3/047* (2013.01); *A45F 2004/023* (2013.01)

(58) Field of Classification Search
CPC ..... A45F 4/02
See application file for complete search history.

(56) References Cited

U.S. PATENT DOCUMENTS 4,029,243 A * 6/1977 Zerobnick ..... A45F 3/00 224/664
5,150,824 A * 9/1992 Alvarez ..... A45F 3/02 D3/226
5,431,316 A * 7/1995 Garcia ..... B60R 22/00 224/264
5,871,132 A * 2/1999 Hargreaves ..... A41D 13/0537 224/675
8,695,859 B1 * 4/2014 Stalker ..... A45F 3/005 135/901
9,125,440 B1 * 9/2015 Guerrero ..... A41D 1/06
9,545,146 B1 * 1/2017 King ..... H04N 1/00111
2002/0134809 A1 * 9/2002 Angus ..... A45F 3/12 224/660
2008/0190980 A1 * 8/2008 Overton ..... A45F 3/14 224/660
2013/0327803 A1 * 12/2013 Chiang ..... A45F 3/04 224/582
2017/0055680 A1 * 3/2017 Donato, Jr. ..... A45F 5/021
2021/0145188 A1 * 5/2021 Thatcher ..... A45F 3/04
2021/0298460 A1 * 9/2021 Livingston ..... A45F 3/04
2022/0087404 A1 * 3/2022 Jacobs ..... A45F 3/02
2022/0192334 A1 * 6/2022 Ratigan ..... A45F 4/02

* cited by examiner

*Primary Examiner* — Brian D Nash
(74) *Attorney, Agent, or Firm* — Gwen R. Acker Wood; ACKER WOOD IP LAW, LLC

(57) ABSTRACT

The present invention provides a unique, versatile, one piece, all-in-one, convertible fanny pack to backpack storage device which allows a user to have completely different-sized bags, from a small fanny pack to a larger backpack, all in one convertible unit. The user can utilize the fanny pack when they have minimal or small items to carry. When the user has multiple items and/or a heavier load to carry, the user can easily convert the fanny pack into the backpack.

10 Claims, 8 Drawing Sheets

CONVERTIBLE ONE-PIECE, ALL-IN-ONE, FANNY PACK TO BACKPACK DEVICE AND METHOD OF USE

CROSS-REFERENCE TO RELATED APPLICATIONS

The present application claims priority to U.S. Provisional Application No. 63,491,977, filed Mar. 24, 2023, which is incorporated herein by reference in its entirety.

BACKGROUND OF THE INVENTION

The present invention is directed to a handbag carrier and, in particular, to a fanny pack that can be converted into a backpack and vice versa.

A fanny pack, also commonly referred to as a waist bag, belt bag, or belly bag typically is manufactured as a small pouch worn like a belt around the waist or across one's body with the use of a belt or strap secured with some type of buckle. A fanny pack commonly is used to carry anything that one would carry in a small handbag, such as money, cell phones, bottled water, snacks, or any other small items. The advantage of using a fanny pack is that it does not have to be carried with one's hands.

A backpack, also commonly referred to as knapsack, rucksack, or bookbag, typically is manufactured as a frameless fabric sack having several storage compartments that is carried on a user's back and secured with straps that go over a user's shoulders. Backpacks commonly are used by hikers, students, and travelers to carry heavy loads and are preferred to other types of bags, as weight is distributed evenly over one's back so that a user can easily carry heavy loads for longer periods of time without having to carry the bag with one's hands.

Fanny packs and backpacks, therefore, both have advantages over other types of bags due to their greater case of carrying items. A user, however, would need to purchase both a fanny pack and a backpack to obtain the advantages of both. Although there are fanny packs and backpacks currently on the market which are sold together in one form or another, up to now there has not been a convertible, all-in-one, one piece fanny pack to backpack device in which the fanny pack converts into a backpack and vice versa, so that it can function either as a fanny pack for smaller storage or as a backpack for larger storage.

SUMMARY OF THE INVENTION

The present invention comprises a convertible, one piece, fanny pack to backpack storage device which includes a built-in compartment on the back side of the fanny back, i.e., the side adjacent to a user's body which, when unzipped, converts, i.e., unfolds, into a backpack. When the backpack is folded within the fanny pack, the backpack is compressed and hidden. When unfolded into a backpack, the fanny pack serves as an outside compartment on the front of the backpack. The convertible fanny pack to backpack is an all-in-one unit, except for a detachable belt and straps that fit the fanny pack or backpack, respectively, on a user.

In an aspect of the invention, there is provided a convertible, one piece, all-in-one fanny pack to backpack device a fanny pack section comprised of a front section and a rear section which are joined together and contiguous with each other. The front and rear sections fold in half and the front and rear sections each has a first end, a second end, a bottom end and a top end. The front section comprises a fanny pack container having an interior opening therein for storage and a cover piece located on the top end of the front section and the rear section. The cover piece extends downwardly over the front section and covers the interior opening of the fanny pack container. The cover piece includes a cover piece zipper closure which secures the cover piece to the fanny pack container. In addition, the first ends, the second ends, and the bottom ends of the front and rear sections of the fanny pack contain a compartment zipper closure which, when zippered, attaches the front and rear sections of the fanny pack to one another and, when unzippered, the front and rear sections of the fanny pack detach from one other, wherein the front section and the rear section of the fanny pack contains a backpack compartment containing backpack components.

In addition, there is a first attachment means located on the first end of the front section of the fanny pack and a second attachment means located on the second end of the front section of the fanny pack; a belt having an attachment means on each end that attaches to the first and second attachments means located on the front section of the fanny pack.

The backpack components includes a backpack container, adjustable shoulder straps, and a top hanging loop. The backpack container has a front side, a rear side, an upper part, a middle part, a bottom part, a top end, a bottom end, a first end, a second end, and an interior storage compartment therein. The bottom part of the backpack container is comprised of the front section of the fanny pack, the middle part is comprised of the rear section of the fanny pack, and the upper part has a backpack zipper closure which opens into the interior storage compartment of the backpack container. The adjustable shoulder straps may include two shoulders straps which include a first adjustable shoulder strap and a second adjustable shoulder strap, each of the shoulder straps located on the rear side of the backpack container, with the first shoulder strap located near the first end and the second shoulder strap located near the second end. In addition, the first shoulder strap has an end attached to the top end of the backpack container and another end attached to the bottom end of the backpack container; and the second shoulder strap has an end attached to the top end of the backpack container and another end attached to the bottom end of backpack container.

Conversion of the fanny pack to the backpack is accomplished by unzipping the compartment zipper to detach the front section and the rear section of the fanny pack from one another to expose the backpack compartment and pulling out and unfolding the backpack components contained in the backpack compartment.

Conversion of the backpack to the fanny pack is accomplished by folding the backpack components into the backpack compartment, attaching the front section and the rear section of the fanny pack to one another by zippering the two sections together with the compartment zipper enclosure, and attaching the belt to the first and second attachment means on the fanny pack.

BRIEF DESCRIPTION OF DRAWINGS

For the present disclosure to be easily understood and readily practiced, the present invention will now be described for purposes of illustration only and are not to be construed as limiting the invention.

DETAILED DESCRIPTION OF THE INVENTION

Figure 1:
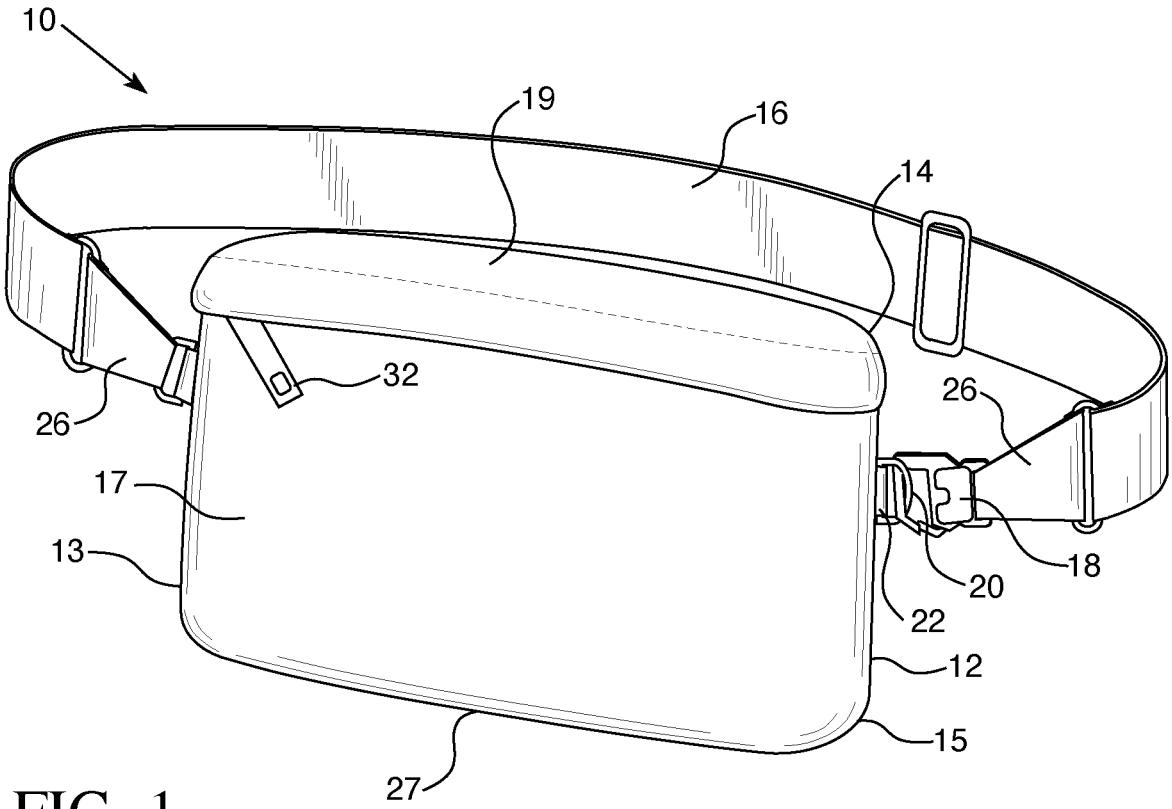
FIG. 1 is a front perspective view of the convertible fanny pack to backpack device when used as a fanny pack with a strap attached to each end of the fanny pack.

In the description that follows, like parts are marked throughout the specification and drawings with the same reference numerals, respectively. The drawings are not necessarily to scale and in some instances sections have been exaggerated in order to depict more clearly certain features of the invention.

As used herein, the terms "fanny pack," "waist bag," "belt bag," and "belly bag" are meant to be interchangeable.

As used herein, the terms "backpack" "knapsack," "packsack," and "haversack" are meant to be interchangeable.

As used herein, the terms "belt" and "strap" are meant to be interchangeable.

Figure 2:
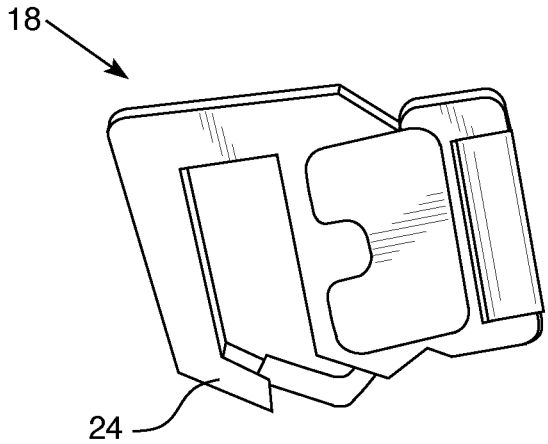
FIG. 2 is a perspective view of one of the clip and slide hook which is used to attach the strap to each end of the fanny pack.
Figure 3:
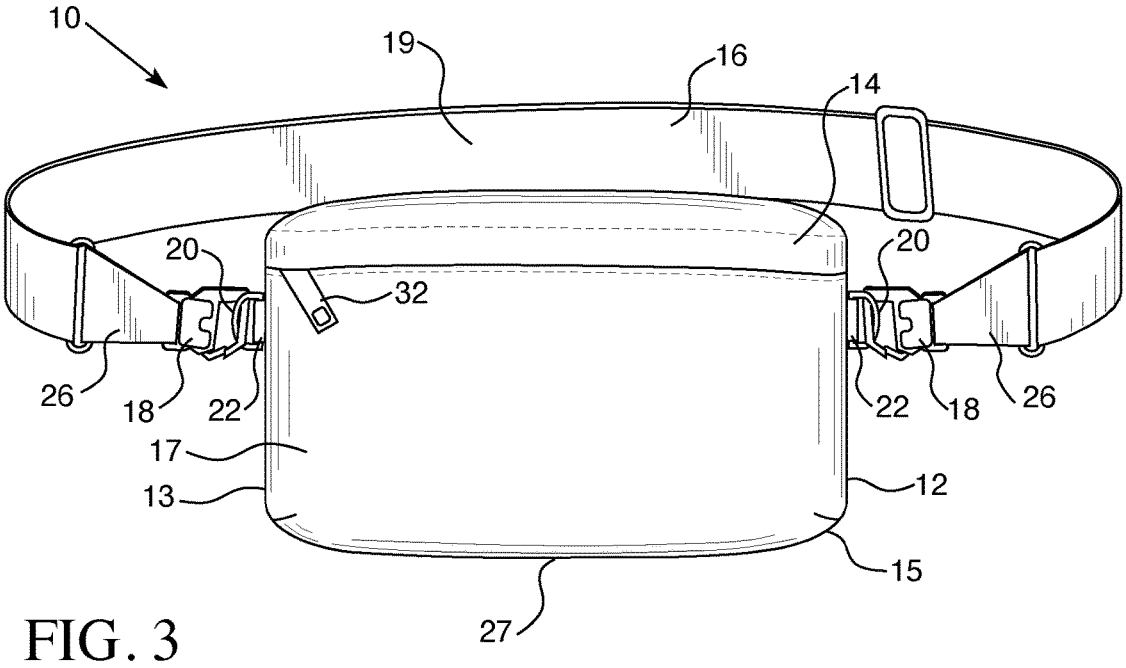
FIG. 3 is a front elevational view of the convertible fanny pack to backpack device when used as a fanny pack with the strap attached to each end of the fanny pack.
Figure 4:
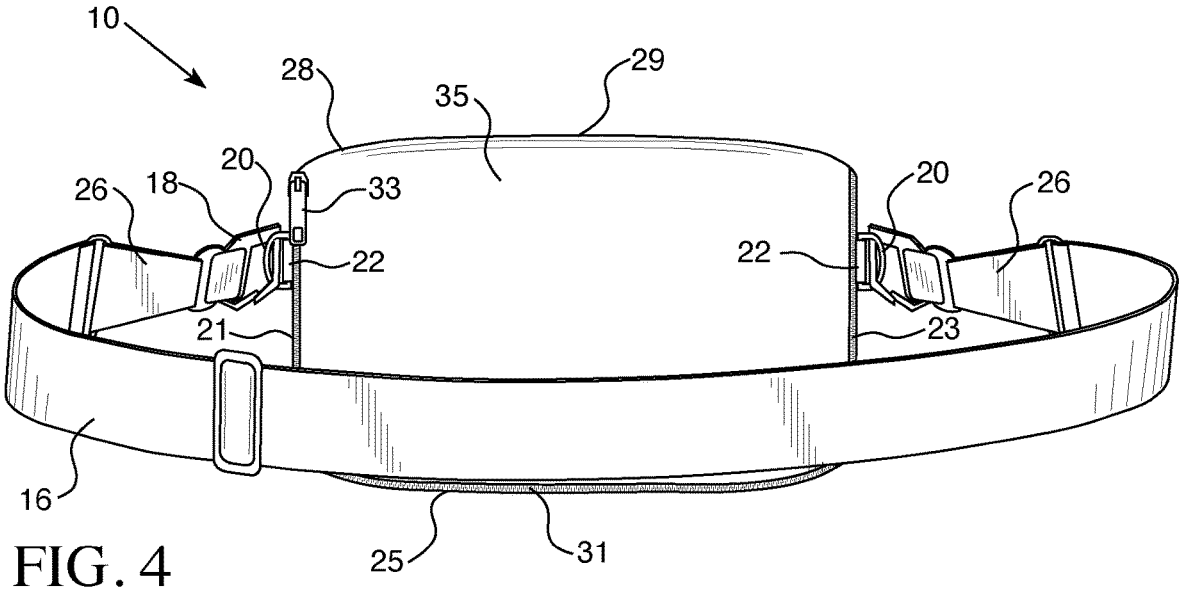
FIG. 4 is a rear elevational view of the convertible fanny pack to backpack device when used as a fanny pack with the strap attached to each end of the fanny pack.
Figure 5:
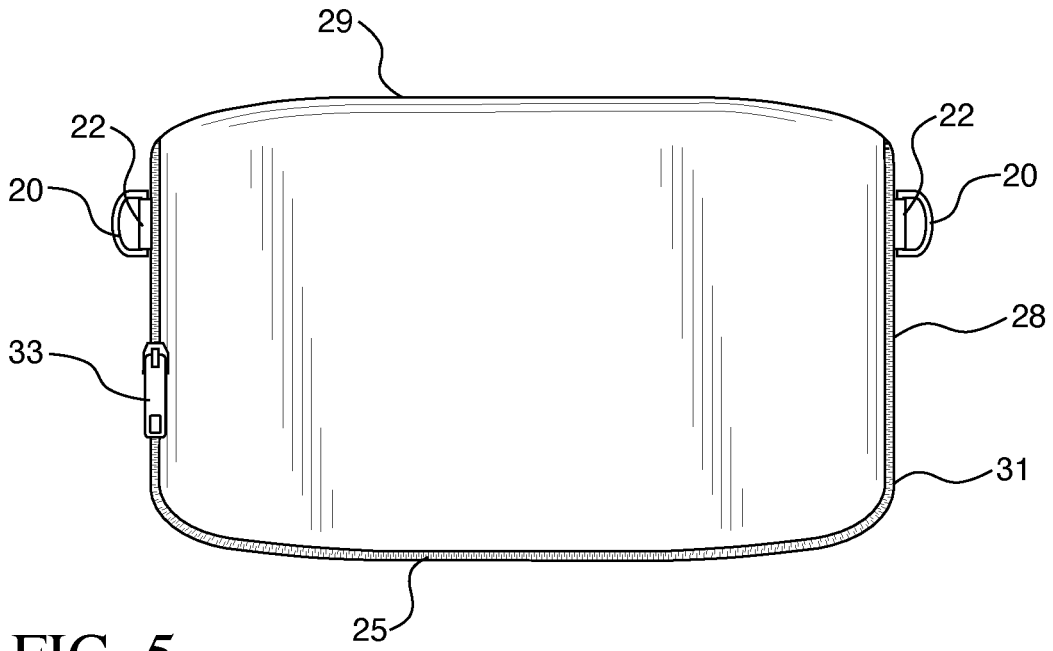
FIG. 5 is a rear elevational view of the convertible fanny pack to backpack device showing the zipper and zipper slider on the periphery of the device.

Referring now to the figures, as shown in FIGS. 1-6, the convertible, one piece, all-in-one fanny pack to backpack device when used as a fanny pack 10 is comprised of fanny pack section which includes a front section 12 (shown in FIGS. 1 and 3) and a rear section 28 (shown in FIGS. 4 and 5). The front section 12 has a front side 17, a rear side 34, a first end 13, a second end 15, a bottom end 27, and a top end 14. The rear section 28 has a front side 35, a rear side 39, a first end 21, a second end 23, a bottom end 25, and a top end 29. The front section 12 and the rear section 28 are joined together and contiguous with each other at their respective top ends 14, 29 and, when used as a fanny pack, are folded in half at their top ends 14, 29 (shown in FIG. 6).

As shown in FIGS. 1 and 3, the front section 12 includes a fanny pack container 17 having an interior opening therein 66 for storage (seen in FIG. 15) and a cover piece 19 located on the top ends 14, 19 of the front and rear sections 12, 28 which extends downwardly over the front section 12 to cover the interior opening of the fanny pack container 17. A cover piece zipper closure 30 with zipper slider 32 secures the cover piece 19 to the fanny pack container 17.

Figure 6:
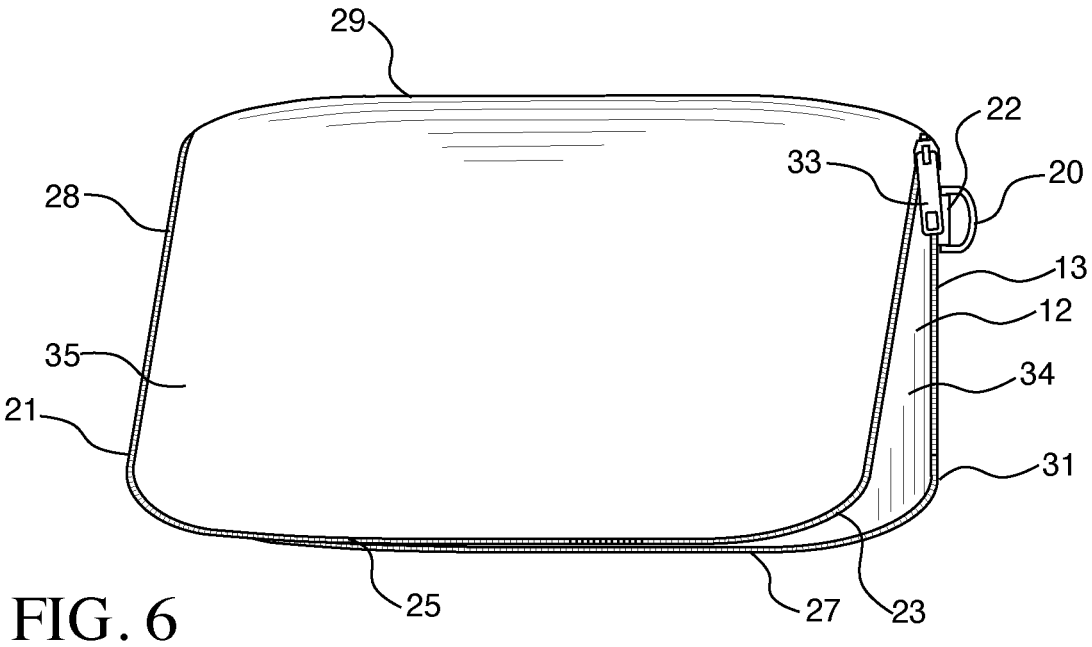
FIG. 6 is a rear perspective view of the convertible fanny pack to backpack device showing the fanny pack when unzipped.

As shown in FIGS. 4-6, the first ends 13, 21, the seconds ends 15, 23, and the bottom ends 27, 25 of the front section 12 and the rear section 28 of the fanny pack 10 contain a compartment zipper closure 31 which attaches the front 12 and rear 28 sections of the fanny pack 10 together when zipped closed.

The fanny pack 10 includes attachments means to attach an adjustable belt 16 to the fanny pack 10 to allow a user to wear the fanny pack 10 around one's waist or across one's body. The attachment means includes a first attachment means on the first end 13 of the front section 12 of the fanny pack 10 and a second attachment means located on the second end 15 of the front section 12 of the fanny pack 10. In an embodiment, the first and second attachments means each includes an insertion piece 22 attached to the first 13 and second 15 ends of the front section 12 of the fanny pack 10. Inserted into each of the insertion pieces 22 is a loop 20. The loops 20 are configured to receive an attachment means located at each end of an adjustable belt 16. The invention contemplates that any suitable adjustable belt having an attachment means compatible for attaching to the first and second attachment means of the fanny back may be employed in the invention. In an embodiment, the attachment means at each of the belt is comprised of a connecting trim 26 adjacent to a clip and slide hook 18, as shown in FIG. 2.

Figure 7:
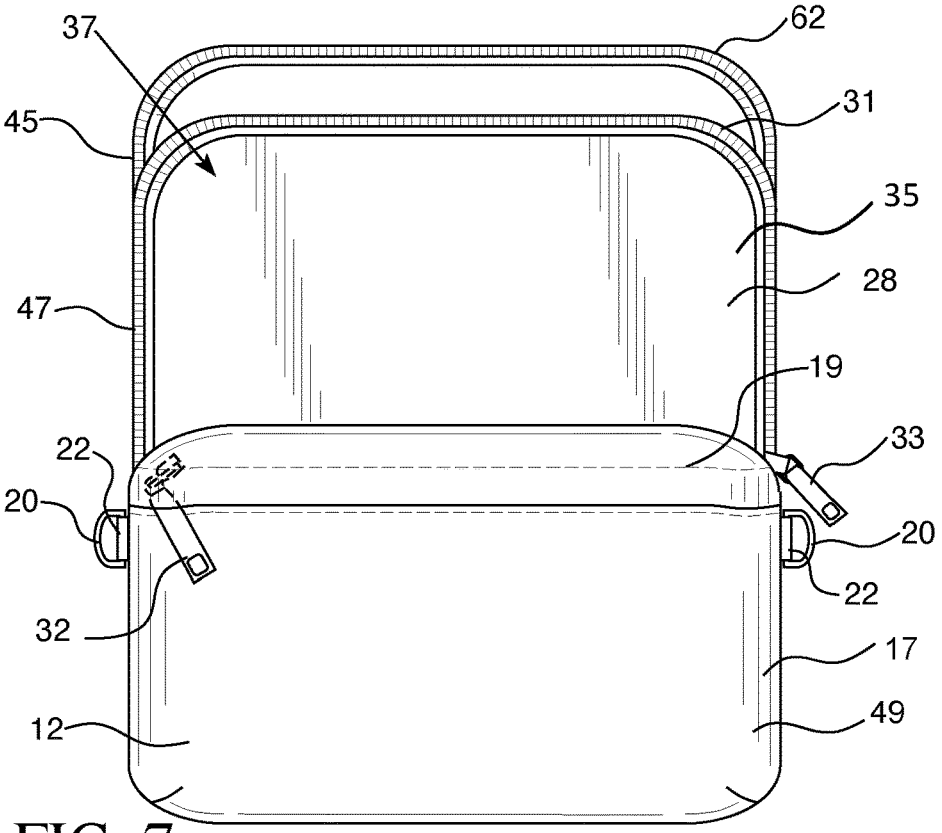
FIG. 7 is a front elevational view of the convertible fanny pack to backpack device showing the front side of the fanny pack when the front and rear sections are unzipped and aligned in one plane
Figure 8:
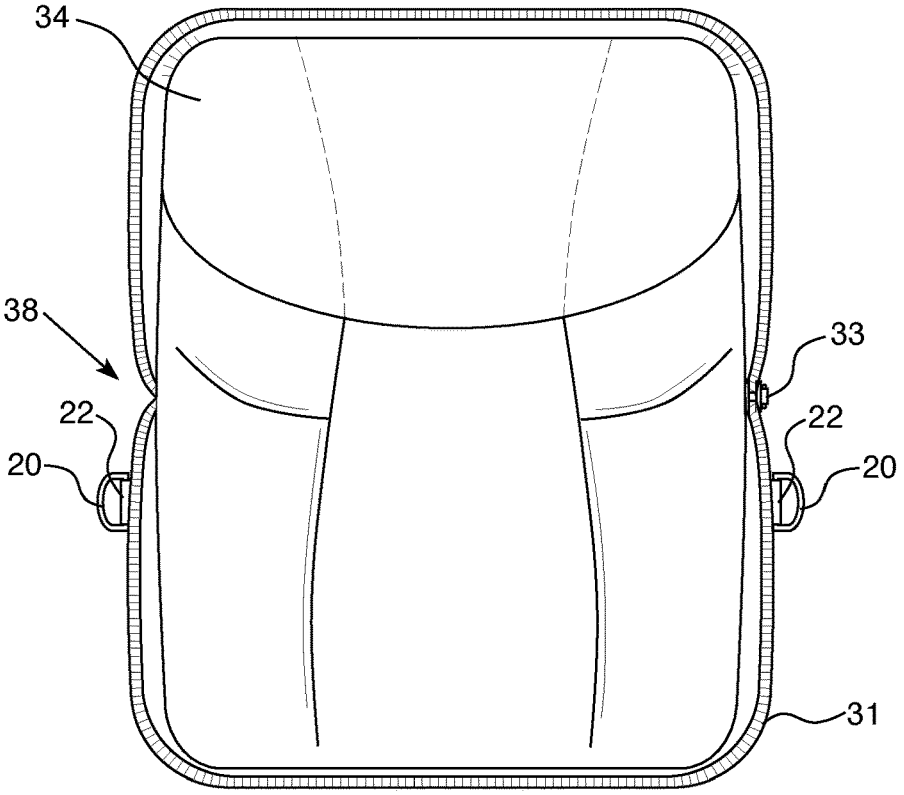
FIG. 8 is a front elevational view of the convertible fanny pack to backpack device showing the rear side of the fanny pack where the backpack components are located when the front and rear sections are unzipped and aligned in one plane

When the compartment zipper closure 31 is opened, the front 12 and rear 28 sections of the fanny pack 10 separate from each other (shown in FIG. 6), open up and lie in a single plane, as shown in FIGS. 7 and 8. The opened up front and rear sections 12, 28 have a front side 37 (shown in FIG. 7) and a rear side 38 (shown in FIG. 8). The front side 37 has a top portion 45, a middle portion 47 and a bottom portion 49. The bottom portion 49 comprises the front section 12 of the fanny pack 10 and contains the front section container 17 and cover piece 19, and the middle portion 47 comprises the front side 35 of the rear section 28 of the fanny pack 10. The rear side 38 of the opened up sections contains a backpack compartment 34 which contains backpack components 40.

Figure 9:
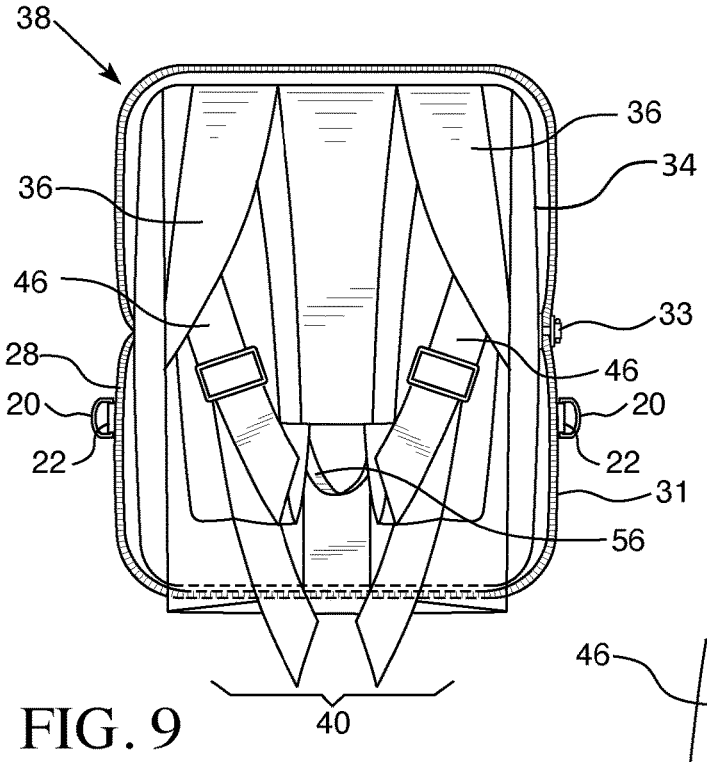
FIG. 9 is a front elevational view of the convertible fanny pack to backpack device showing the backpack compartment and the unfolded backpack components.
Figure 10:
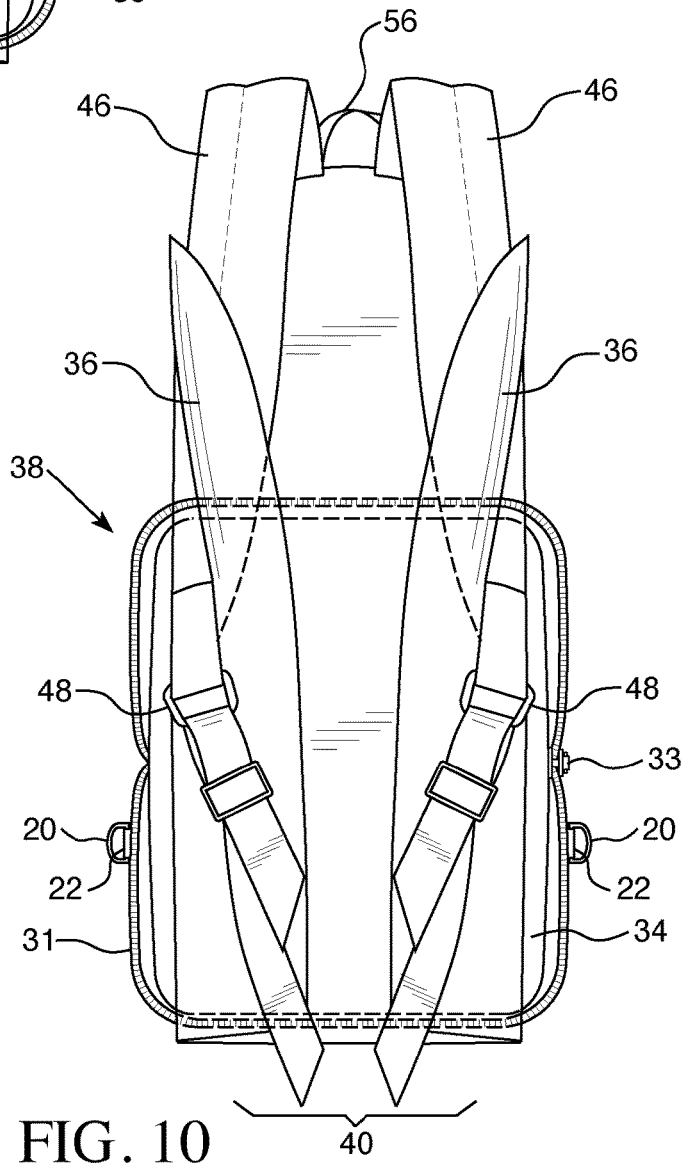
FIG. 10 is a front elevational view of the convertible fanny pack to backpack device showing the backpack compartment and the backpack components partially unfolded.

As shown in FIG. 9, the backpack compartment 34 contains backpack components 40 which are folded within the backpack compartment 34. The backpack components 40 include, but are not limited to, a backpack container 36, two adjustable shoulder straps 46, and a hanging loop 56. FIG. 10 shows the backpack components 40 pulled out and partially unfolded from the backpack compartment 34.

Conversion of the fanny pack 10 to the backpack 50 is accomplished when the backpack components 40 are completely pulled out of the backpack compartment 34 and completely unfolded.

The convertible, one piece, all-in-one fanny pack to backpack device when converted to a backpack is shown in FIGS. 11-15. The backpack 50 includes the backpack container 36 having an interior opening storage compartment 68 (shown in FIG. 15), adjustable shoulder straps 46, and a top hanging loop 56. The backpack container 36 includes all of the elements of the backpack except for the adjustable shoulder straps and the top hanging loop, and thus the following description of the backpack container 36 (i.e., minus the adjustable shoulder straps and the top hanging loop) applies equally to the backpack 50 and vice versa.

Figure 11:
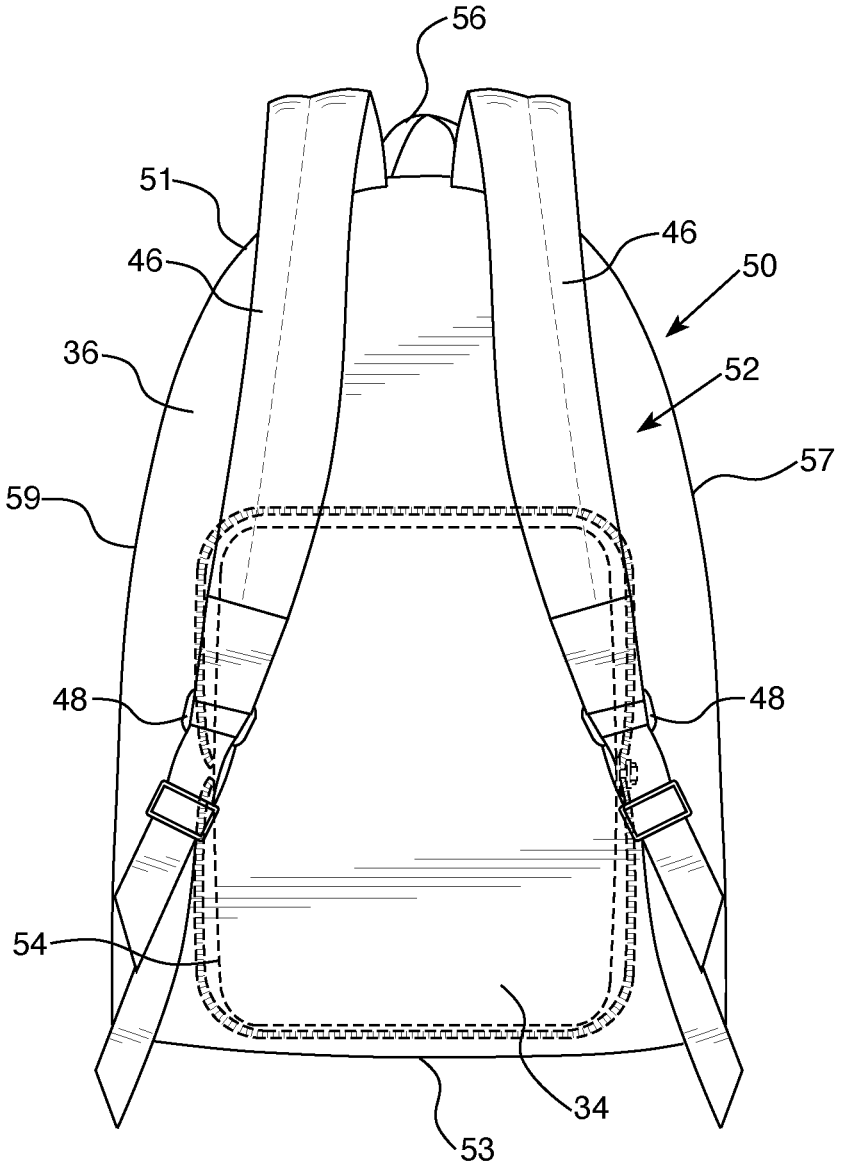
FIG. 11 is a rear elevational view of the convertible fanny pack to backpack device showing the backpack completely unfolded and indicating the location of the front and rear sections of the fanny pack on the front side of the backpack.
Figure 12:
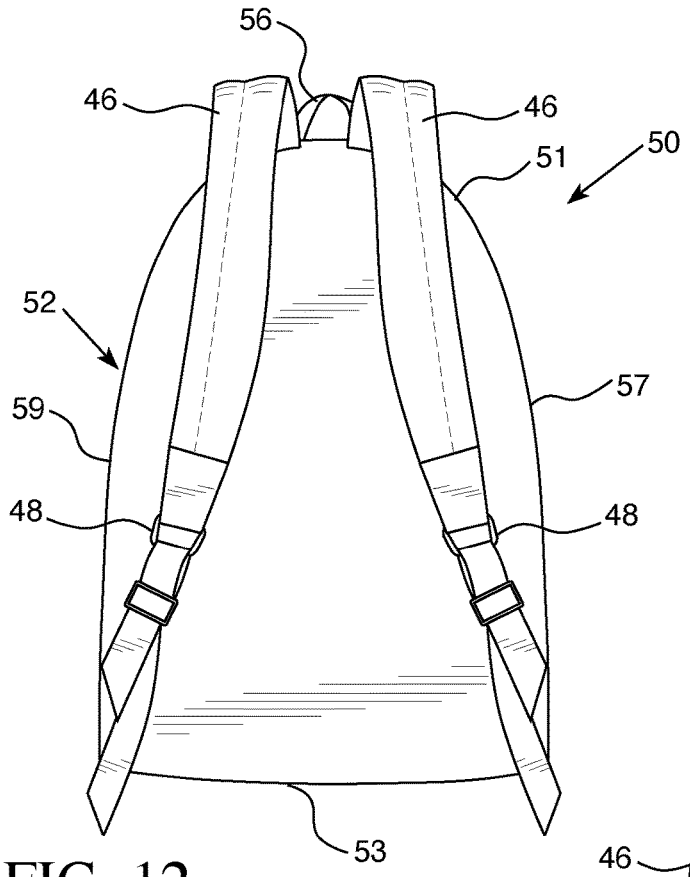
FIG. 12 is a rear elevational view of the convertible fanny pack to backpack device showing the device converted to the backpack.

The backpack 50 has a rear side 52 (shown in FIGS. 11 and 12), a front side 58 (shown in FIGS. 13-15), a top end 51, a bottom end 53, a first end 57, and a second end 59. FIG. 11 is a rear side 52 view of the backpack 50 indicating the location of the backpack compartment 34. As shown in FIGS. 11 and 12, the rear side 52 of the backpack container 36 includes the adjustable shoulder straps 46. In an embodiment, one shoulder strap 46 is located near the first end 57 of the backpack container 36 and the other shoulder strap 46 is located near the second end 59 of the backpack container 36. One end of each of the shoulder straps 46 is attached to the top end 51 of the backpack container 36 and the other end is attached to the bottom end 53 of the backpack container 36. A hanging loop 56 may be placed on the top end 51 of the backpack container 36 so that the device when converted to the backpack can also be carried by hand of a user.

Figure 13:
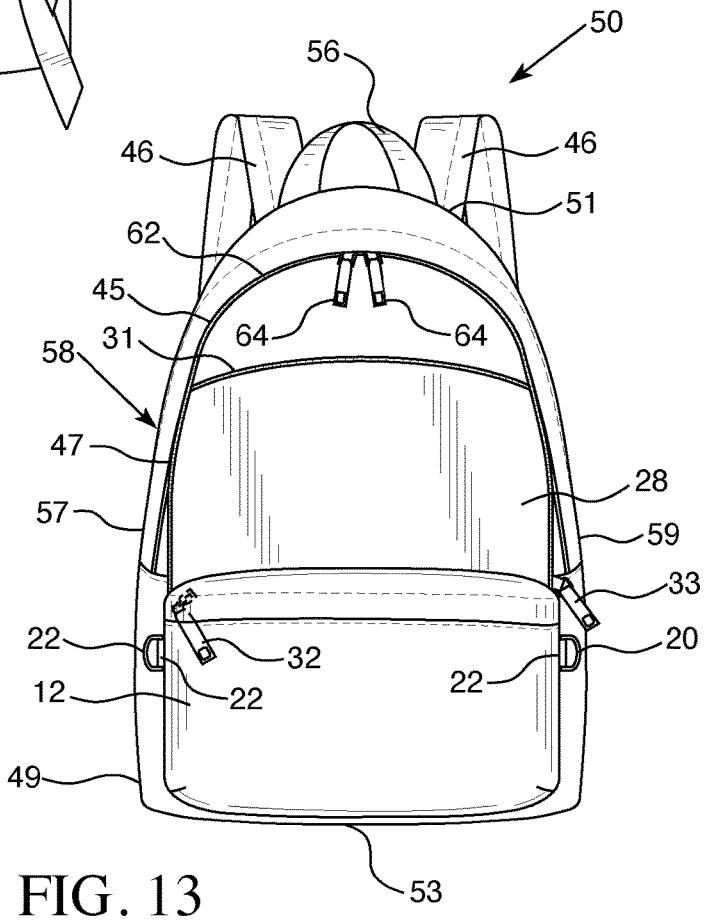
FIG. 13 is a front elevational view of the convertible fanny pack to backpack device showing the device converted to the backpack.
Figure 14:
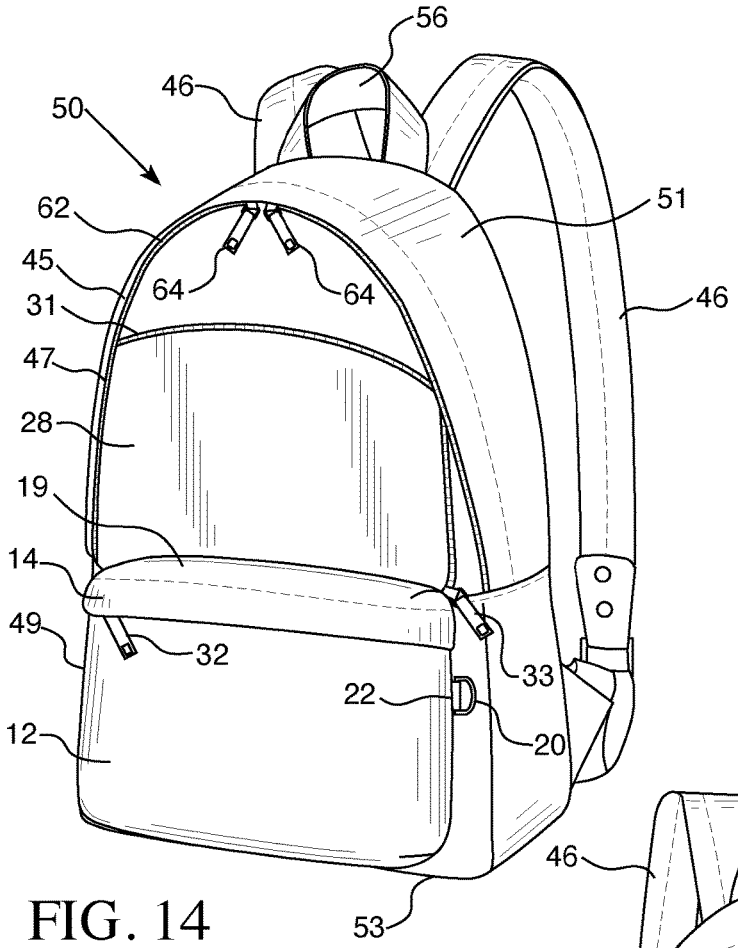
FIG. 14 is a front perspective view of the convertible fanny pack to backpack device showing the device converted to the backpack.
Figure 15:
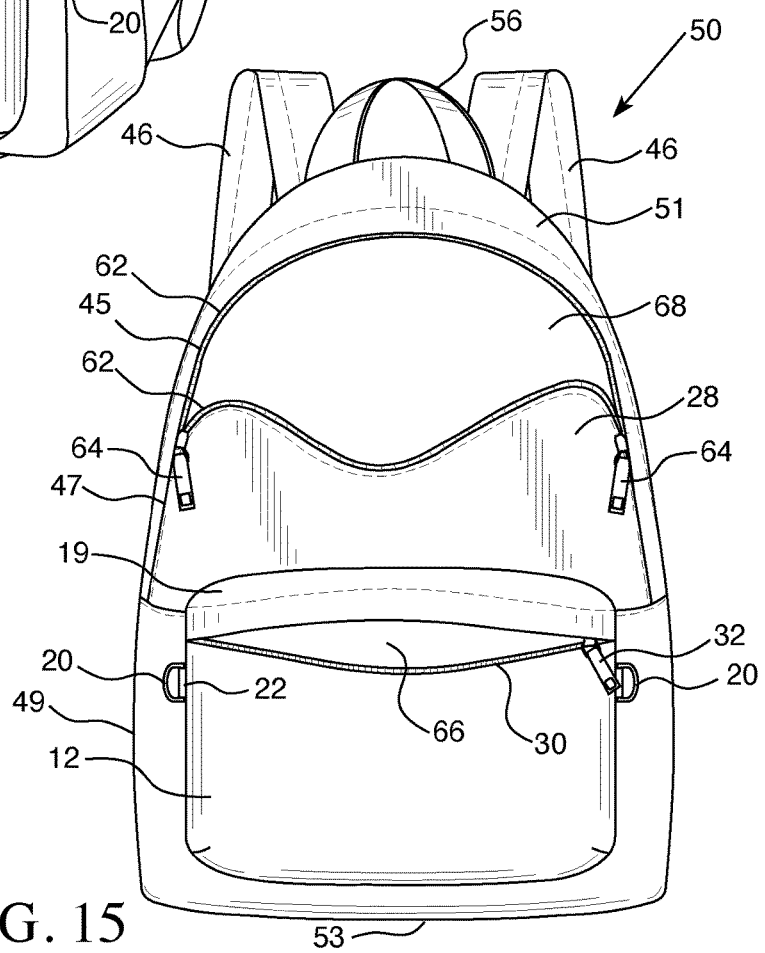
FIG. 15 is a front elevational view of the convertible fanny pack to backpack device showing the device converted to the backpack with the fanny pack zipper opened and with the backpack top zipper opened.

Referring now to FIGS. 13-15, the front side 58 of the backpack 50 has an upper part 45, a middle part 47, and a bottom part 49. The backpack 50 has an opening on its upper part 45 which provides access to the interior storage compartment 68 (shown in FIG. 15). The lower part 49 of the backpack 50 is comprised of the front section 12 of the fanny pack 10 and the middle part 47 is comprised of the rear section of the fanny pack 28. The opening to the interior storage compartment 68 has a backpack zipper closure 62 with a zipper slider 64.

As shown in FIGS. 13 and 14, when the device is converted to the backpack 50, the compartment zipper 31 of the rear section 28 of the fanny pack 10 is located between the top part 45 and the middle part 47 on the front side 58 of the backpack 50.

In an embodiment of the invention, both the fanny pack zipper closure and the backpack zipper closure are concealed when zippered.

The device when converted to the backpack 50 contains, without limitation, a bottom storage compartment comprised of the fanny pack container 17 and a top storage compartment comprised of the interior storage compartment 68 of the backpack container 36.

Conversion of the fanny pack 10 to the backpack 50 is accomplished by a user by detaching the belt 16 from the first and the second attachment means on the fanny pack 10, unzipping the compartment zipper enclosure 31 of the front and rear sections 12, 28 of the fanny pack 10 so that the bottom ends 25, 27 of the front and rear sections 12, 28 separate from each other and align in one plane. The backpack components 40 contained within the backpack compartment 38 are pulled out of the backpack compartment 38 and completely unfolded into the converted backpack 50.

Conversion of the backpack 50 to the fanny pack 10 is accomplished by a user by folding the backpack components 40 into the backpack compartment 38, attaching the front section 12 and the rear section 28 of the fanny pack to one another by zippering the two sections together with the compartment zipper enclosure 30, and then attaching the belt 16 to the first and second attachment means on the fanny pack 10.

The invention contemplates that any suitable material may be used to fabricate the fanny pack, backpack container, adjustable straps, belt and other soft materials, including, but not limited to, polyester, canvas, leather, and other natural or synthetic fabrics or materials; and any suitable material may be used for the zippers, clips with slide hooks, and loops, including, but not limited to, plastics or metals.

The convertible fanny pack to backpack of the present invention allows a user to have completely different-sized bags, from small to large, in one convertible unit. A user can utilize the fanny pack when they have minimal things to carry, and when the user has multiple and/or heavy items to carry, the fanny pack easily converts into a backpack to increase storage space and ease of carriage.

The convertible fanny pack to backpack device allows travelers to bring a single bag which can be converted from a small storage space to a large storage space based on the amount of items they intend to take on a trip.

For hikers/adventurers, the convertible fanny pack to backpack device provides one bag that converts in size as the hike/adventure progresses. Thus, a user can start out with a backpack full of items and over the course of the trip the backpack can be converted to a fanny pack as those items are used up or discarded.

In urban settings, the convertible fanny pack to backpack allows urban users to have a backpack instantly in situations when additional space is needed, such as during shopping trips.

For parents, the convertible fanny pack to backpack is especially useful to carry items for their children, such as baby supplies, food, drinks, and toys.

For sports and recreational activities, the convertible fanny pack to backpack allows users to convert the bag as needed to carry more or less over the course of a day, such as in stadiums or amusement parks.

Thus, the option of having various compartment sizes between the fanny pack and the backpack of the invention provides extraordinary functionality.

While the invention has been particularly shown and described with reference to embodiments described above, it will be understood by those skilled in the art that various alterations in form and detail may be made therein without departing from the spirit and scope of the invention, as defined by the appended claims.

The invention claimed is:

1. A convertible, one piece, all-in-one fanny pack to backpack device, comprising:

a fanny pack section comprised of a front section and a rear section which are joined together and contiguous with each other, said front and rear sections folded in half, said front section and said rear section each having a first end, a second end, a bottom end and a top end, wherein the front section comprises a fanny pack container having an interior opening therein for storage, a cover piece located on the top ends of the front section and the rear section, said cover piece extending downwardly over the front section and covering the interior opening of the fanny pack container, and a cover piece zipper closure which secures the cover piece to the fanny pack container, wherein the first ends, the second ends, and the bottom ends of the front and rear sections of the fanny pack contain a compartment zipper closure which, when zippered, attaches the front and rear sections of the fanny pack to one another and, when unzippered, the front and rear sections of the fanny pack detach from one other, wherein the front section and rear section of the fanny pack contains a backpack compartment;

a first attachment means located on the first end of the front section of the fanny pack and a second attachment means located on the second end of the front section of the fanny pack;

a belt having an attachment means on each end that attaches to the first and second attachments means located on the front section of the fanny pack; and backpack components, comprising:

a backpack container having a front side, a rear side, an upper part, a middle part, a bottom part, a top end, a bottom end, a first end, a second end, and an interior storage compartment therein, wherein the bottom part of the backpack container is comprised of the front section of the fanny pack, the middle part is comprised of the rear section of the fanny pack, and the upper part has a backpack zipper closure which opens into the interior storage compartment of the backpack container; and a first adjustable shoulder strap and a second adjustable shoulder strap, each of the shoulder straps located on the rear side of the backpack container, the first shoulder strap located near the first end and the second shoulder strap located near the second end; the shoulder strap having an end attached to the top end of the backpack container and another end attached to the bottom end of the backpack container; and the second shoulder strap having an end attached to the top end of the backpack container and another end attached to the bottom end of backpack container, wherein conversion of the fanny pack to the backpack is accomplished by unzipping the front section and the rear section of the fanny pack to expose the backpack compartment and pulling out and unfolding the backpack components contained in the backpack compartment, and wherein conversion of the backpack to the fanny pack is accomplished by folding the backpack components into the backpack compartment, attaching the front section and the rear section of the fanny pack to one another by zippering the two sections together with the compartment zipper enclosure, and attaching the belt to the first and second attachment means on the fanny pack.

2. The convertible, one piece, all-in-one fanny pack to backpack device of claim 1, wherein the first attachment means and the second attachment means located on the front section of the fanny pack comprises a connector insertion piece and a loop inserted in the insertion piece.

3. The convertible, one piece, all-in-one fanny pack to backpack device of claim 2, wherein an adjustable, detachable belt having an attachment means at each end inserts into the loops on the fanny pack so that a user can belt the fanny pack around the waist or across a chest and shoulder.

4. The convertible, one piece, all-in-one fanny pack to backpack device of claim 3, wherein the insertion means of the belt comprises a clip and slide hook on each end which attaches to the loops on the fanny pack.

5. The convertible one piece, all-in-one fanny pack to backpack device of claim 4, wherein a connecting trim is adjacent to the clip and slide hook, wherein the end of the connecting trim opposite to the adjacent clip and slide hook contains an adjustable buckle to adjust the length of the belt.

6. The convertible, one piece, all-in-one fanny pack to backpack device of claim 1, wherein the backpack contains a bottom storage compartment and a top storage compartment, said bottom storage compartment comprised of the interior opening of the fanny pack container on the bottom part of the front side of the backpack, said top storage compartment comprised of the interior storage compartment of the backpack container.

7. The convertible one piece, all-in-one fanny pack to backpack device of claim 1, wherein the fanny pack zipper closure and the backpack zipper closure are concealed while in use.

8. The convertible one piece, all-in-one fanny pack to backpack device of claim 1, wherein when converted to a backpack, the compartment zipper of the rear section of the fanny pack is located between the top part and the middle part of the front side of the backpack.

9. A method for converting the convertible, one piece, all-in-one fanny pack to backpack device of claim 1 from a fanny pack to a backpack, said method comprising:

(a) detaching the belt from the first and second attachment means located on the fanny pack;

(b) unzipping the compartment zipper closure of the fanny pack to separate the front section and the rear section from one another;

(b) spreading apart the bottom ends of the front section from the rear section so that the two sections are aligned in one plane; and (c) pulling out and unfolding the backpack components from the backpack compartment.

10. A method for converting the convertible, one piece, all-in-one fanny pack to backpack device of claim 1 from a backpack to a fanny pack, said method comprising:

(a) folding the backpack components into the backpack compartment;

(b) attaching the front section and the rear section of the fanny pack to one another by zippering the two sections together with the compartment zipper enclosure; and (c) attaching the ends of the belt to the first and second attachment means located on the fanny pack.

* * * * *